US008655663B2

(12) United States Patent
Matsuoka et al.

(10) Patent No.: US 8,655,663 B2
(45) Date of Patent: Feb. 18, 2014

(54) AUDIO SIGNAL INTERPOLATION DEVICE AND AUDIO SIGNAL INTERPOLATION METHOD

(75) Inventors: Masaki Matsuoka, Kanagawa (JP); Shigeki Namiki, Kanagawa (JP)

(73) Assignee: D&M Holdings, Inc., Kanagawa (JP)

( * ) Notice: Subject to any disclaimer, the term of this patent is extended or adjusted under 35 U.S.C. 154(b) by 968 days.

(21) Appl. No.: 12/681,550

(22) PCT Filed: Sep. 29, 2008

(86) PCT No.: PCT/JP2008/067609

§ 371 (c)(1),
(2), (4) Date: Apr. 2, 2010

(87) PCT Pub. No.: WO2009/054228

PCT Pub. Date: Apr. 30, 2009

(65) Prior Publication Data

US 2010/0228550 A1 Sep. 9, 2010

(30) Foreign Application Priority Data

Oct. 26, 2007 (JP) ..... 2007-278662
Mar. 31, 2008 (JP) ..... 2008-090381

(51) Int. Cl.
*G10L 13/02* (2013.01)

(52) U.S. Cl.
USPC ..... 704/265; 704/224; 704/500; 381/86; 381/22; 340/4.37

(58) Field of Classification Search
USPC ..... 704/500–504, 265, 224, 278; 381/86, 2, 381/20, 22, 18; 340/4.37; 330/149
See application file for complete search history.

(56) References Cited

U.S. PATENT DOCUMENTS 3,772,479 A 11/1973 Hilbert
3,943,293 A 3/1976 Bailey
3,989,897 A 11/1976 Carver
4,308,424 A 12/1981 Bice et al.

(Continued)

FOREIGN PATENT DOCUMENTS

DE 3331352 A 3/1985
EP 0097982 A 1/1984

(Continued)

OTHER PUBLICATIONS

International Search Report for PCT/US87/00099; completion date of search: Jun. 12, 1987.

(Continued)

*Primary Examiner* — Vijay B Chawan
(74) *Attorney, Agent, or Firm* — Peter A. Nieves; Sheehan Phinney Bass + Green PA

(57) ABSTRACT

An audio signal interpolation device is presented, including an input unit for receiving an input audio signal, a phase splitting unit for splitting the input audio signal, a high range interpolation unit for interpolating a high range component into the signal, a phase combining unit for combining an in-phase component signal with a differential phase component, a high-pass filter for high-pass filtering the audio signal from by the phase combining unit, a delay unit for producing a delayed audio signal, and an addition processing unit for adding the delayed audio signal to the audio signal output from the high-pass filter.

8 Claims, 4 Drawing Sheets

(56) References Cited

U.S. PATENT DOCUMENTS

| | | | | | |
|---|---|---|---|---|---|
| 4,349,698 | A | | 9/1982 | Makoto | |
| 4,356,349 | A | | 10/1982 | Robinson | |
| 4,393,270 | A | | 7/1983 | Vandeberg | |
| 4,394,536 | A | | 7/1983 | Shima | |
| 4,605,950 | A | * | 8/1986 | Goldberg et al. | 348/389.1 |
| 5,181,249 | A | * | 1/1993 | Schiller | 381/27 |
| 5,214,705 | A | * | 5/1993 | Kloker et al. | 381/2 |
| 5,373,562 | A | | 12/1994 | Albean | |
| 5,377,272 | A | * | 12/1994 | Albean | 381/13 |
| 5,610,944 | A | * | 3/1997 | Mau et al. | 375/260 |
| 5,796,844 | A | * | 8/1998 | Griesinger | 381/18 |
| 5,864,800 | A | * | 1/1999 | Imai et al. | 704/229 |
| 6,005,506 | A | * | 12/1999 | Bazarjani et al. | 341/143 |
| 6,266,644 | B1 | * | 7/2001 | Levine | 704/503 |
| 6,359,577 | B1 | * | 3/2002 | Weigel | 341/147 |
| 6,697,491 | B1 | * | 2/2004 | Griesinger | 381/20 |
| 7,107,211 | B2 | * | 9/2006 | Griesinger | 704/228 |
| 8,194,791 | B2 | * | 6/2012 | Endres et al. | 375/326 |
| 2010/0100208 | A1 | | 4/2010 | Saunders | |
| 2010/0250871 | A1 | | 9/2010 | Rossiter | |

FOREIGN PATENT DOCUMENTS

| | | | |
|---|---|---|---|
| JP | 3-505030 | A | 10/1991 |
| JP | 3-285410 | A | 12/1991 |
| JP | 6-216805 | A | 8/1994 |
| JP | 2000-91921 | A | 3/2000 |
| JP | 2002-131346 | A | 5/2002 |
| JP | 2005-173607 | A | 6/2005 |
| WO | 87/06090 | | 10/1987 |
| WO | 90/11670 | | 10/1990 |
| WO | 2009/054228 | A1 | 4/2009 |

OTHER PUBLICATIONS

International Search Report for PCT/US89/01167; completion date of search: Nov. 27, 1989.

International Search Report for PCT/JP2008/067609; completion date of search: Dec. 3, 2008.

Kurozumi, K and Ohgushi, K., "A new sound image broadening control system using a correlation coefficient variation method," Electronics and Communications in Japan, 1984, pp. 33-41, vol. 67-A, No. 6, Scripta Publishing Co., Silver Spring, Maryland.

* cited by examiner (a)

(b)

AUDIO SIGNAL INTERPOLATION DEVICE AND AUDIO SIGNAL INTERPOLATION METHOD

TECHNICAL FIELD

The present invention relates to an audio signal interpolation device for subjecting an audio signal to an interpolation processing and an audio signal interpolation method therefor.

BACKGROUND ART

Compressed audio data in Moving Picture Expert Group audio layer-3 (MP3) or other such format has a signal having a component in a high range (for example, equal to or higher than 16 kHz) cut off when being subjected to a compression processing. Therefore, the compressed audio data in MP3 or other such format has lower sound quality than an audio signal obtained before the compression. In order to enhance the quality of such audio data, for example, JP 2002-175092 A discloses means for reproducing audio data by interpolating therein a high frequency component cut off by the compression processing.

DISCLOSURE OF THE INVENTION

In the method disclosed in the above-mentioned publication, a high frequency component of an audio signal with a limited band is partially restored, and the restored high frequency component is added to the original audio signal to thereby interpolate the high frequency component lost by the compression processing. However, in such a simple interpolation method, the added high frequency component and a fundamental tone component of the audio signal exhibit a weak correlation, which may cause the interpolated audio signal to sound unnatural to a listener.

Further, an effect of the interpolated audio signal that can be caught by a user thereof is likely to vary depending upon a compression ratio of compressed audio data, compression means therefor, a reproducing apparatus for reproducing the compressed audio data, a reproducing environment thereof, an audible frequency band of the user, or the like. This may cause the user to find it difficult to recognize the effect of the interpolation in listening to the interpolated audio signal.

The present invention has been made in order to solve the above-mentioned problems, and it is an object thereof to provide an audio signal interpolation device capable of interpolating a high frequency component that exhibits a good correlation with a fundamental tone component into an audio signal in which a high frequency component has been cut off by a compression processing.

It is another object of the present invention to provide an audio signal interpolation device capable of causing a user to visually recognize an effect of interpolating a component.

In order to solve the above-mentioned problems, an audio signal interpolation device according to a first aspect of the present invention includes: an input unit for receiving an input of an audio signal in which a high range component has been cut off; a phase splitting unit for splitting the audio signal input to the input unit into each of an in-phase component signal and a differential phase component signal; a high range interpolation unit for interpolating a high range component into the in-phase component signal and the differential phase component signal that are output from the phase splitting unit; a phase combining unit for combining the in-phase component signal and the differential phase component signal into which the high range component has been interpolated by the high range interpolation unit; a high-pass filter for performing high-pass filtering on the audio signal combined by the phase combining unit and outputting the audio signal formed of the high range component; a delay unit for delaying the audio signal input to the input unit by a time period corresponding to a phase delay generated by an interpolation processing; and an addition processing unit for adding the audio signal delayed by the delay unit and the audio signal output from the high-pass filter.

In the audio signal interpolation device configured as described above, the high range interpolation unit includes: a cut-off frequency detection unit for detecting a cut-off frequency of the each of the in-phase component signal and the differential phase component signal; an envelope generation unit for generating envelope information on the cut-off frequency of the each of the in-phase component signal and the differential phase component signal, which is detected by the cut-off frequency detection unit; and an interpolation unit for interpolating a component in a range higher than the cut-off frequency of the each of the in-phase component signal and the differential phase component based on the envelope information created by the envelope generation unit.

Further, the interpolation unit interpolates a band equal to or lower than a Nyquist frequency of the input audio signal that has been sampled.

In order to solve the above-mentioned problems, an audio signal interpolation device according to a second aspect of the present invention includes: a high range interpolation unit for interpolating a high range component into an audio signal and outputting the obtained audio signal; and a display control unit for generating display data for displaying spectra of audio signals obtained before and after interpolation performed by the high range interpolation unit in different modes.

In the audio signal interpolation device configured as described above: the high range interpolation unit further includes: an input unit for receiving an input of an audio signal in which the high range component has been cut off; a phase splitting unit for splitting the audio signal input to the input unit into each of an in-phase component signal and a differential phase component signal; a high range interpolation unit for interpolating a high range component into the in-phase component signal and the differential phase component signal that are output from the phase splitting unit; a phase combining unit for combining the in-phase component signal and the differential phase component signal into which the high range component has been interpolated by the high range interpolation unit; a high-pass filter for performing high-pass filtering on the audio signal combined by the phase combining unit and outputting the audio signal formed of the high range component; a delay unit for delaying the audio signal input to the input unit by a time period corresponding to a phase delay generated by an interpolation processing; and an addition processing unit for adding the audio signal delayed by the delay unit and the audio signal output from the high-pass filter; and the display control unit generates the display data based on frequency data and level data that are acquired from in-phase component signals and differential phase component signals obtained before and after being subjected to interpolation.

In order to solve the above-mentioned problems, an audio signal interpolation method according to a third aspect of the present invention includes the steps of: receiving an input of an audio signal in which a high range component has been cut off; splitting the input audio signal into each of an in-phase component signal and a differential phase component signal; interpolating a high range component into the in-phase component signal and the differential phase component signal; combining the in-phase component signal and the differential phase component signal into which the high range component has been interpolated; performing high-pass filtering on the combined audio signal and outputting the audio signal formed of the high range component; delaying the input audio signal by a time period corresponding to a phase delay generated by an interpolation processing; and adding the delayed audio signal and the audio signal subjected to the high-pass filtering.

In the audio signal interpolation method configured as described above, the step of interpolating the high range component includes the steps of: detecting a cut-off frequency of the each of the in-phase component signal and the differential phase component signal; generating envelope information on the detected cut-off frequency of the each of the in-phase component signal and the differential phase component signal; and interpolating a component in a range higher than the cut-off frequency of the each of the in-phase component signal and the differential phase component based on the created envelope information.

Further, the step of interpolating includes interpolating a band equal to or lower than a Nyquist frequency of the input audio signal that has been sampled.

In order to solve the above-mentioned problems, an audio signal interpolation method according to a fourth aspect of the present invention includes the steps of: interpolating a high range component into an audio signal and outputting the obtained audio signal; and generating display data for displaying spectra of audio signals obtained before and after interpolation in different modes.

In the audio signal interpolation method configured as described above: the step of interpolating the high range component further includes the steps of: detecting a cut-off frequency of each of the in-phase component signal and the differential phase component signal; generating envelope information on the detected cut-off frequency of the each of the in-phase component signal and the differential phase component signal; and interpolating a component in a range higher than the cut-off frequency of the each of the in-phase component signal and the differential phase component based on the created envelope information; and the step of generating the display data includes generating the display data based on frequency data and level data that are acquired from in-phase component signals and differential phase component signals obtained before and after being subjected to interpolation.

BEST MODE FOR CARRYING OUT THE INVENTION

First Embodiment

Hereinafter, description is made of a first embodiment of the present invention with reference to the accompanying drawings.

Figure 1:
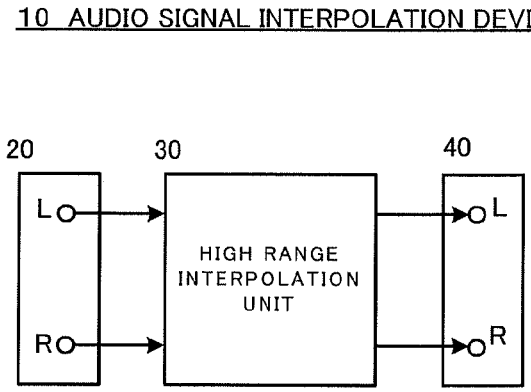
FIG. 1 is a block diagram illustrating a configuration of an audio signal interpolation device according to a first embodiment.

FIG. 1 is a block diagram illustrating a configuration of an audio signal interpolation device according to an embodiment of the present invention. As illustrated in FIG. 1, an audio signal interpolation device 10 according to this embodiment includes an input unit 20, a high range interpolation unit 30, and an output unit 40. The audio signal interpolation device according to this embodiment is provided to an audio-visual (AV) amplifier or a player capable of reproducing audio data in MP3 or other such format.

The audio signal interpolation device 10 according to this embodiment receives a left channel (Lch) audio signal and a right channel (Rch) audio signal that form a stereo audio signal being a digital signal from the input unit 20. A high frequency component is interpolated into the input Lch and Rch audio signals by the high range interpolation unit 30. The audio signals having the high frequency component interpolated are output from the output unit 40.

Figure 2:
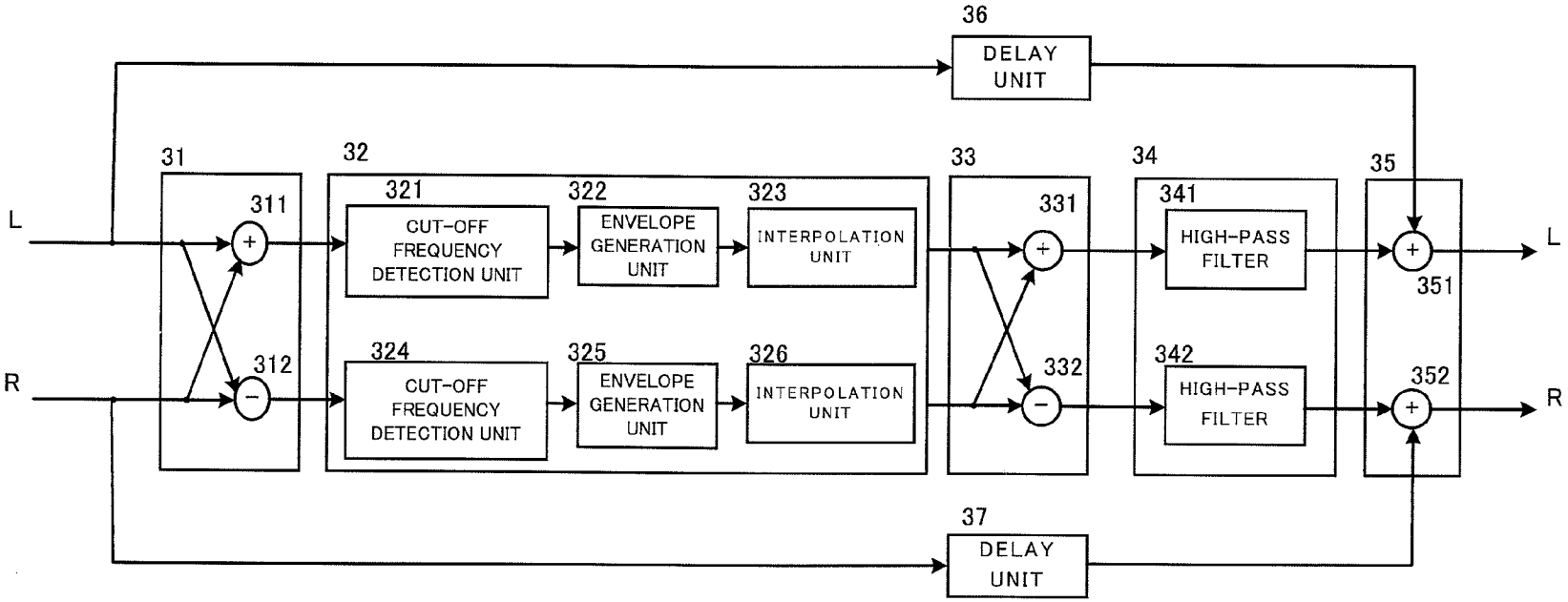
FIG. 2 is a block diagram illustrating a configuration of a high range interpolation unit.

FIG. 2 is a block diagram illustrating a configuration of the high range interpolation unit 30 according to this embodiment. As illustrated in FIG. 2, the high range interpolation unit 30 includes a phase splitting unit 31, an interpolation processing unit 32, a phase combining unit 33, a filter unit 34, an addition processing unit 35, a delay unit 36, and a delay unit 37.

As illustrated in FIG. 2, the Lch and Rch audio signals input from the input unit 20 are input to the phase splitting unit 31 and the delay unit 36.

The phase splitting unit 31 includes combining units 311 and 312, and splits the Lch and Rch audio signals input from the input unit 20 into an in-phase component (|L+R|) and a differential phase component (|L−R|). An in-phase component signal is obtained by the combining unit 311 combining the Lch audio signal and the Rch audio signal. A differential phase component signal is obtained by the combining unit 312 inverting the Lch audio signal and combining the Rch audio signal therewith.

The interpolation processing unit 32 includes a cut-off frequency detection unit 321, an envelope generation unit 322, and an interpolation unit 323 which are used for subjecting the input in-phase component signal to a processing for interpolating a treble component thereinto.

The cut-off frequency detection unit 321 performs a spectral analysis by using a fast Fourier transform or the like, and detects a cut-off frequency fc of the in-phase component signal input to the interpolation processing unit 32.

The envelope generation unit 322 performs a cepstrum analysis based on a spectral distribution of the in-phase component signal obtained from the spectral analysis performed by the cut-off frequency detection unit 321 to thereby generate envelope information on the cut-off frequency fc detected by the cut-off frequency detection unit 321.

The interpolation unit 323 defines a frequency band for interpolating a high range component from the detected cut-off frequency fc based on the generated envelope information, and interpolates the high range component into the frequency band of the in-phase component signal input to the interpolation processing unit 32.

The interpolation processing unit 32 further includes a cut-off frequency detection unit 324, an envelope generation unit 325, and an interpolation unit 326 which are used for subjecting the input differential phase component signal to a processing for interpolating a treble component thereinto.

The cut-off frequency detection unit 324 performs a spectral analysis by using a fast Fourier transform or the like, and detects a cut-off frequency fc of the differential phase component signal input to the interpolation processing unit 32.

The envelope generation unit 325 performs a cepstrum analysis based on a spectral distribution of the differential phase component signal obtained from the spectral analysis performed by the cut-off frequency detection unit 324 to thereby generate envelope information on the cut-off frequency fc detected by the cut-off frequency detection unit 324.

The interpolation unit 326 defines a frequency band for interpolating a treble component from the detected cut-off frequency fc based on the generated envelope information, and interpolates the high frequency component into the frequency band of the differential phase component signal input to the interpolation processing unit 4.

The phase combining unit 33, which includes combining units 331 and 332, combines the in-phase component signal and the differential phase component signal that are input from the interpolation processing unit 32, and outputs an Lch audio signal and an Rch audio signal. The combining unit 331 outputs the Lch audio signal obtained by combining the in-phase component signal and the differential phase component signal. The combining unit 332 outputs the Rch audio signal obtained by combining the inverted in-phase component signal and the differential phase component signal.

The filter unit 34 includes high-pass filters 341 and 342. The high-pass filter 341 eliminates a component equal to or lower than the cut-off frequency fc of the Lch audio signal output from the combining unit 331. The high-pass filter 342 cuts off a component equal to or lower than the cut-off frequency fc of the Rch audio signal output from the combining unit 332.

The addition processing unit 35 includes an adding unit 351 and an adding unit 352. The adding unit 351 adds the Lch audio signal output from the high-pass filter 341 and the Lch audio signal output from the delay unit 36. The adding unit 352 adds the Rch audio signal output from the high-pass filter 342 and the Rch audio signal output from the delay unit 37.

The delay unit 36 delays the Lch audio signal input from the input unit 20 by a time period corresponding to a phase delay generated by the processings of the phase splitting unit 31, the interpolation processing unit 32, the phase combining unit 33, and the filter unit 34.

The delay unit 37 delays the Rch audio signal input from the input unit 20 by a time period corresponding to a phase delay generated by the processings of the phase splitting unit 31, the interpolation processing unit 32, the phase combining unit 33, and the filter unit 35.

Figure 3:
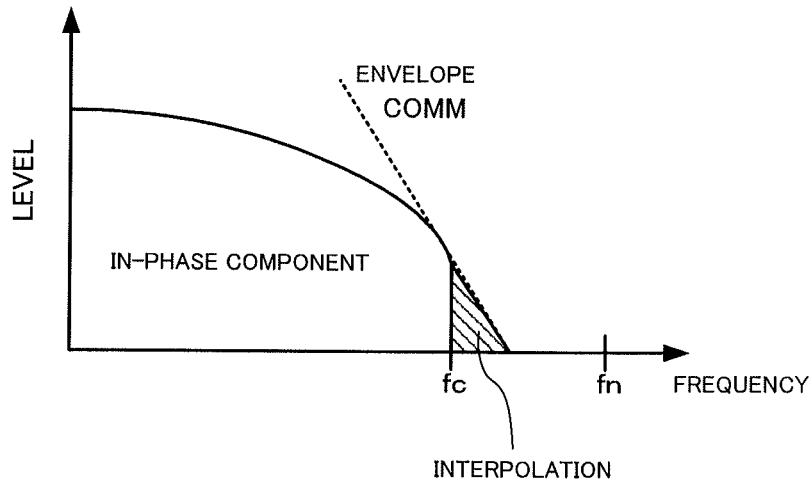
FIG. 3 are explanatory diagrams of an interpolation processing for a high frequency component.
Figure 3:
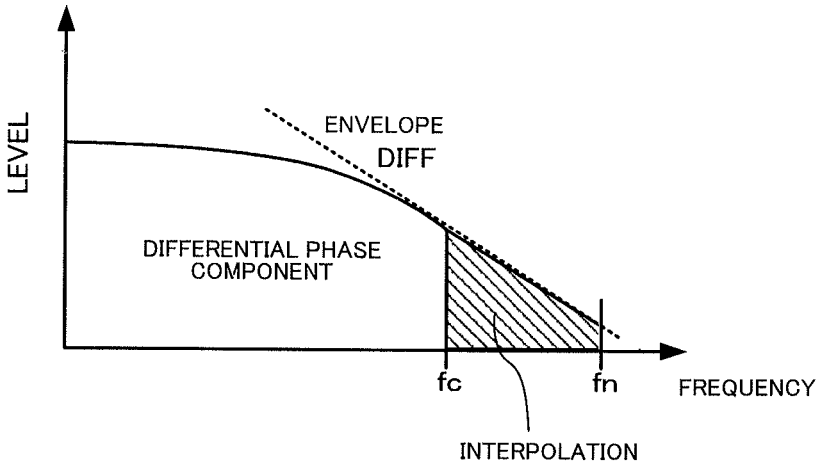

Next described is an interpolation processing performed by the interpolation processing unit 32 in the audio signal interpolation device 10 according to this embodiment. FIG. 3 are explanatory diagrams of an interpolation processing for a high frequency component.

In a graph representing a spectrum of the in-phase component signal which is illustrated in FIG. 3(*a*), fc represents the cut-off frequency of the in-phase component signal detected by the cut-off frequency detection unit 321, and fn represents a Nyquist frequency of the input audio signal that has been sampled. In a graph representing a spectrum of the differential phase component signal which is illustrated in FIG. 3(*b*), fc represents the cut-off frequency of the differential phase component signal detected by the cut-off frequency detection unit 324, and fn represents the Nyquist frequency.

Because the audio signal input to the audio signal interpolation device 10 is a stereo signal, the cut-off frequency fc illustrated in FIG. 3(*a*) and the cut-off frequency fc illustrated in FIG. 3(*b*) are substantially the same frequency, and the Nyquist frequency fn illustrated in FIG. 3(*a*) and the Nyquist frequency illustrated in FIG. 3(*b*) are substantially the same frequency as well. In a case where the stereo audio signal is compressed audio data in MP3 or other such format, the cut-off frequency fc is 16 kHz. Further, the Nyquist frequency fn is, for example, 22.05 kHz.

The envelope illustrated in FIG. 3(*a*) is an envelope at the cut-off frequency fc which has been generated based on the in-phase component signal and the differential phase component signal by the envelope generation unit 322, and has an inclination at the cut-off frequency fc represented by COMM. The envelope illustrated in FIG. 3(*b*) is an envelope at the cut-off frequency fc which has been generated based on the in-phase component signal and the differential phase component signal by the envelope generation unit 45, and has an inclination at the cut-off frequency fc represented by DIFF.

In this embodiment, the inclination COMM of the envelope of the in-phase component signal is steeper than the inclination DIFF of the envelope of the differential phase component signal. This is because, generally in the stereo audio signal, harmonic components such as an echo component and a reverberation component are contained at high level even in a treble of the differential phase component signal, while harmonic components such as a vocal sound and a fundamental tone of a musical instrument are of ten contained in the in-phase component signal and attenuate in the treble.

In a normal state, the audio signal has its spectral component decreasing in level in the treble. Therefore, as described above, the in-phase component signal and the differential phase component signal have their spectral components decreasing in level in the treble, but there occurs a difference in the manner of decreasing. According to this embodiment, by using the difference in the decrease of the spectral component, high frequency components are separately interpolated along the envelopes of the cut-off frequencies fc of the in-phase component signal and the differential phase component signal, thereby enabling interpolation so as to be a signal closer to an original sound.

In the interpolation processing unit 32, the interpolation unit 323 subjects the input in-phase component signal to a fast Fourier transform analysis and then to a frequency shift processing or the like to thereby interpolate a high frequency component into a frequency band ranging from the cut-off frequency fc to the Nyquist frequency along the envelope having the inclination COMM.

As illustrated in FIG. 3(*a*), if a frequency f at an intersection between the envelope and the frequency axis is lower than the Nyquist frequency fn (that is, if $fc \leq f \leq fn$), the interpolation unit 323 interpolates a high frequency component into the frequency band ranging from the cut-off frequency fc to the frequency f at the intersection. Accordingly, the high frequency component interpolated into the in-phase component signal by the interpolation unit 323 results in an area indicated by the shaded portion illustrated in FIG. 3(*a*).

Further, the interpolation unit 326 subjects the input differential phase component signal to a fast Fourier transform analysis and then to a frequency shift processing or the like to thereby interpolate a high frequency component into a frequency band ranging from the cut-off frequency fc to the Nyquist frequency along the envelope having the inclination DIFF.

As illustrated in FIG. 3(*b*), a frequency f at an intersection between the envelope and the frequency axis is higher than the Nyquist frequency fn, and therefore the interpolation unit 326 interpolates a high frequency component into the frequency band ranging from the cut-off frequency fc to the Nyquist frequency fn. Accordingly, the high frequency component interpolated into the differential phase component signal by the interpolation unit 326 results in an area indicated by the shaded portion illustrated in FIG. 3(*b*).

The in-phase component signal and the differential phase component signal into which the high frequency components have been interpolated as illustrated in FIGS. 3(*a*) and 3(*b*) are combined with each other by the phase combining unit 33 to become the Lch audio signal and the Rch audio signal. In the Lch and Rch audio signals, the components equal to or lower than the cut-off frequency fc are cut off by the filter unit 34, and the high frequency components on Lch and Rch interpolated by the interpolation processing unit 32 are extracted.

The addition processing unit 35 adds the high frequency components on Lch and Rch that have been extracted by the filter unit 34 to the Lch and Rch audio signals that have been output from the delay unit 36 and the delay unit 37, respectively. Here, the Lch and Rch audio signals that are to be input to the addition processing unit 35 are previously delayed by the delay unit 36 and the delay unit 37, respectively, so as to become the same audio signals as the audio signals subjected to the interpolation processing by the interpolation processing unit 32.

As described above, in this embodiment, the input audio signals are phase-split, and the band exceeding the cut-off frequency is interpolated into each of an in-phase signal and a differential phase signal that have been split. Accordingly, a high range component exhibiting a better correlation with a fundamental tone component can be interpolated into the audio signal that has lost a high frequency component by the compression processing. This prevents the audio signal into which the high frequency component has been interpolated from sounding unnatural to a listener.

Second Embodiment

Hereinafter, description is made of an audio signal interpolation device according to a second embodiment of the present invention.

Figure 4:
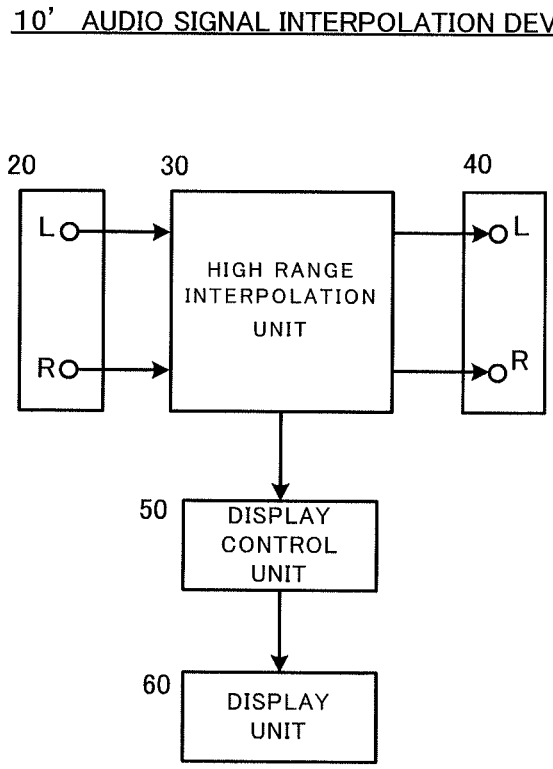
FIG. 4 is a block diagram illustrating a configuration of an audio signal interpolation device according to a second embodiment.

FIG. 4 is a block diagram illustrating a configuration of the audio signal interpolation device according to the second embodiment. Note that in order to facilitate an understanding thereof, in FIG. 4, the same constituents as those of FIG. 1 are denoted by the same reference numerals, and description thereof is omitted.

An audio signal interpolation device 10' includes a display control unit 50 and a display unit 60.

The display control unit 50 generates display data to be displayed on the display unit 60 from frequency data and level data that are acquired by the spectral analysis performed by the high range interpolation unit 30. The display unit 60 is provided with a fluorescent display tube, a light emitting diode (LED), or the like, and displays the spectra of the audio signal obtained before the high frequency component is interpolated thereinto and the audio signal obtained after the high frequency component is interpolated thereinto.

Figure 5:
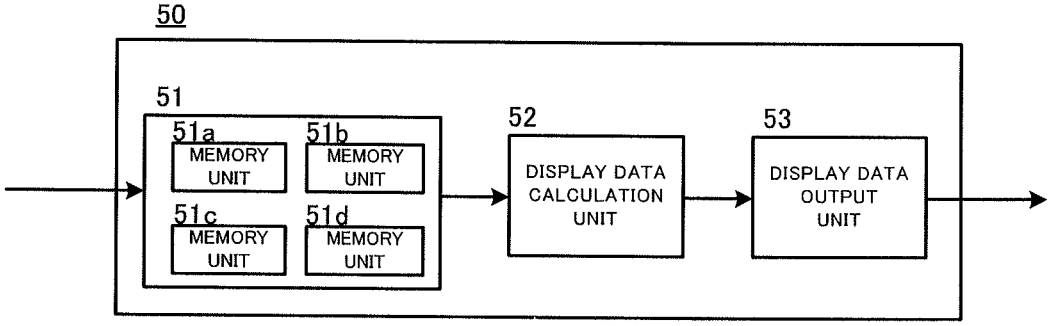
FIG. 5 is a block diagram illustrating a configuration of a display control unit.

FIG. 5 is a block diagram illustrating a configuration of the display control unit 50 according to this embodiment. As illustrated in FIG. 5, the display control unit 50 includes a memory control unit 51, a display data calculation unit 52, and a display data output unit 53. In addition, the memory control unit 51 includes a memory unit 51*a*, a memory unit 51*b*, a memory unit 51*c*, and a memory unit 51*d*.

The memory control unit 51 stores in the memory unit 51*a* the frequency data and the level data on the in-phase component signal obtained before the high frequency component is interpolated thereinto, which have been obtained by the spectral analysis in the cut-off frequency detection unit 321. In addition, the memory control unit 51 stores in the memory unit 51*b* the frequency data and the level data on the differential phase component signal obtained before the high frequency component is interpolated thereinto, which have been obtained by the spectral analysis in the cut-off frequency detection unit 324. The memory control unit 51 performs such control that the frequency data and the level data acquired from the cut-off frequency detection unit 321 and the cut-off frequency detection unit 324 at the same timing are stored in the memory unit 51*a* and the memory unit 51*b*. The cut-off frequency is also stored in the memory unit 51*a* and the memory unit 51*b*.

In addition, the memory control unit 51 acquires the frequency data and the level data from the in-phase component signal into which the high frequency component has been interpolated by the interpolation unit 323 and the differential phase component signal into which the high frequency component has been interpolated by the interpolation unit 325. The frequency data and the level data on the in-phase component signal acquired from the interpolation unit 323 are stored in the memory unit 51*c*. The frequency data and the level data on the differential phase component signal acquired from the interpolation unit 325 are stored in the memory unit 51*d*. The cut-off frequency is also stored in the memory unit 51*c* and the memory unit 51*d*.

In this embodiment, the memory control unit 51 controls an acquiring timing so that the frequency data and the level data are acquired from the in-phase component signal and the differential phase component signal that are the same before and after the high frequency component is interpolated thereinto. Of the level data (obtained from separately the in-phase component signal and the differential phase component signal) acquired at this acquiring timing, the larger level data is chosen.

The display data calculation unit 52 generates the display data for displaying on the display unit 60 spectral representations of the audio signals obtained before and after the high frequency component is interpolated thereinto. The display unit 60 displays thereon frequency information and spectral information based on the display data.

The display data calculation unit 52 reads the respective frequency data and the respective level data that are stored in the memory control unit 51, calculates the display data that represents the spectrum of the audio signal obtained before the high frequency component is interpolated thereinto, and calculates the display data that represents the spectrum of the signal obtained after the high frequency component is interpolated thereinto. Then generated is the display data for the spectral representation chosen by a user. The representations before and after the interpolation are calculated and displayed by using the cut-off frequency corresponding to the chosen level data as a boundary.

Further, the display data calculation unit 52 performs a comparison between the display data obtained before the high frequency component is interpolated thereinto and the display data obtained after the high frequency component is interpolated thereinto, and generates the display data so that the frequency band in which the high frequency component is not interpolated and the frequency band in which the high frequency component is interpolated are displayed in different modes (such as colors or display methods). The display data generated by the display data calculation unit 52 is stored in the display data output unit 53 and then output to the display unit 60.

Accordingly, the audio signal interpolation device 10' according to this embodiment can generate the display data to be displayed on the display unit 60 by using the frequency data and the level data acquired from the high range interpolation unit 30, which eliminates the need to newly include a configuration for analyzing the frequency data and the level data.

Figure 6:
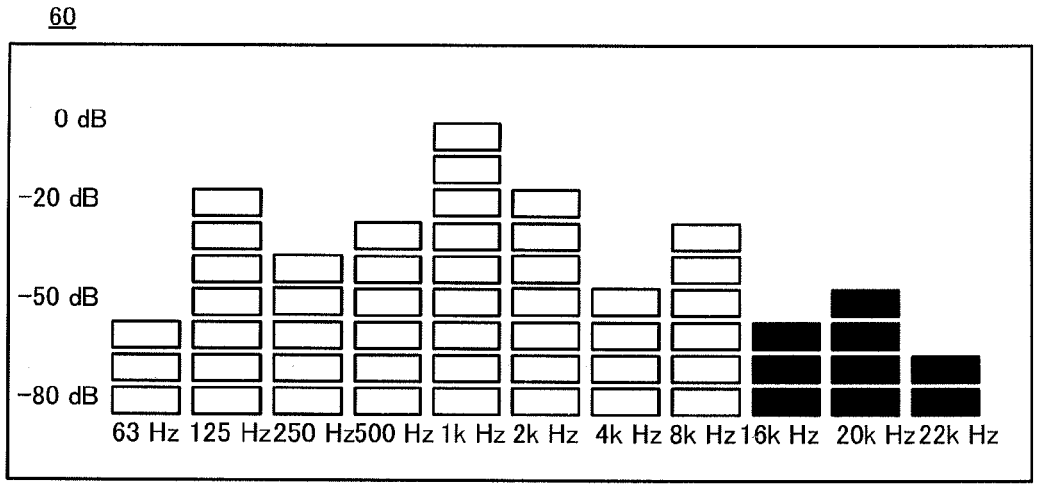
FIG. 6 is a diagram illustrating a display example in which spectral representations are displayed on a display unit.

FIG. 6 illustrates a display example in which the spectral representations are displayed on the display unit 60. In the spectral representations illustrated in FIG. 6, the ordinate and the abscissa are set as the level (dB) and the frequency (Hz), respectively, and the white color and the black color represent the frequency band in which the high frequency component is not interpolated and the frequency band in which the high frequency component is interpolated, respectively.

As illustrated in FIG. 6, the original component of the output audio signal and the interpolated component are displayed in the different modes on the display unit 60, which allows the user to know an interpolation state with ease.

As described above, the audio signal interpolation device according to this embodiment allows the user to visually recognize the frequency band in which the high range component is interpolated. Accordingly, the user can clearly visually recognize effects produced when the component is interpolated in the audio signal interpolation device according to this embodiment.

Further, according to this embodiment, which need not include a configuration for analyzing the original component and interpolated component, a band interpolation can be performed with a simpler configuration and the effects thereof can be displayed at the same time.

The present invention is not limited to the above-mentioned embodiments, and various changes, modifications, and the like can be made.

For example, the above-mentioned embodiments are described with regard to the case of processing a two-channel stereo audio signal. However, the present invention is not limited thereto, and can be applied to a multichannel signal.

Japanese Patent Application No. 2007-278662 (filed in Oct. 26, 2007) and Japanese Patent Application No. 2008-90381 (filed in Mar. 31, 2008) are incorporated herein by reference in its entirety including the specification, scope of claims, drawings, and abstract.

INDUSTRIAL APPLICABILITY

The present invention can be used for the processing for interpolating an audio signal, and therefore has industrial applicability.

The invention claimed is:

1. An audio signal interpolation device, comprising:

an input unit for receiving an input audio signal in which a high range component has been cut off;

a phase splitting unit for splitting the input audio signal into an in-phase component signal and a differential phase component signal;

a high range interpolation unit for interpolating a high range component into the in-phase component signal and the differential phase component signal from the phase splitting unit;

a phase combining unit for combining the in-phase component signal and the differential phase component signal into which the high range component has been interpolated by the high range interpolation unit;

a high-pass filter for high-pass filtering the audio signal combined by the phase combining unit, and outputting the audio signal formed of the high range component;

a delay unit for producing a delayed audio signal by delaying the input audio signal by a time period corresponding to a phase delay generated by an interpolation processing; and an addition processing unit for adding the delayed audio signal to the audio signal output from the high-pass filter.

2. The audio signal interpolation device according to claim 1, wherein the high range interpolation unit comprises:

a cut-off frequency detection unit for detecting a cut-off frequency of the in-phase component signal and the differential phase component signal;

an envelope generation unit for generating envelope information on the cut-off frequency of the in-phase component signal and the differential phase component signal, which is detected by the cut-off frequency detection unit; and an interpolation unit for interpolating a component in a range higher than the cut-off frequency of the in-phase component signal and the differential phase component based on the envelope information created by the envelope generation unit.

3. The audio signal interpolation device according to claim 2, wherein the interpolation unit interpolates a band equal to or lower than a Nyquist frequency of the input audio signal that has been sampled.

4. The audio signal interpolation device according to claim 1, wherein:

the high range interpolation unit further comprises:

an input unit for receiving an input audio signal in which the high range component has been cut off;

a phase splitting unit for splitting the input audio signal input into an in-phase component signal and a differential phase component signal;

a high range interpolation unit for interpolating a high range component into the in-phase component signal and the differential phase component signal from the phase splitting unit;

a phase combining unit for combining the in-phase component signal and the differential phase component signal into which the high range component has been interpolated by the high range interpolation unit;

a high-pass filter for high-pass filtering the audio signal combined by the phase combining unit and outputting the audio signal formed of the high range component;

a delay unit for producing a delayed audio signal by delaying the input audio by a time period corresponding to a phase delay generated by an interpolation processing;

an addition processing unit for adding the delayed audio signal to the audio signal output from the high-pass filter; and the display control unit for generating display data based on frequency data and level data that are acquired from in-phase component signals and differential phase component signals obtained before and after being subjected to interpolation.

5. An audio signal interpolation method, comprising the steps of:

receiving an input audio signal in which a high range component has been cut off;

splitting the input audio signal into an in-phase component signal and a differential phase component signal;

interpolating a high range component into the in-phase component signal and the differential phase component signal;

combining the in-phase component signal and the differential phase component signal into which the high range component has been interpolated;

performing high-pass filtering on the combined audio signal and outputting the audio signal formed of the high range component;

delaying the input audio signal by a time period corresponding to a phase delay generated by an interpolation processing; and adding the delayed audio signal and the audio signal subjected to the high-pass filtering.

6. The audio signal interpolation method according to claim 5, wherein the step of interpolating the high range component comprises the steps of:

detecting a cut-off frequency of the in-phase component signal and the differential phase component signal;

generating envelope information on the detected cut-off frequency of the in-phase component signal and the differential phase component signal; and interpolating a component in a range higher than the cut-off frequency of the in-phase component signal and the differential phase component based on the created envelope information.

7. The audio signal interpolation method according to claim 6, wherein the step of interpolating comprises interpolating a band equal to or lower than a Nyquist frequency of the input audio signal that has been sampled.

8. The audio signal interpolation method according to claim 5, wherein:

the step of interpolating the high range component further comprises the steps of:

detecting a cut-off frequency of each of the in-phase component signal and the differential phase component signal;

generating envelope information on the detected cut-off frequency of the in-phase component signal and the differential phase component signal;

interpolating a component in a range higher than the cut-off frequency of the in-phase component signal and the differential phase component based on the created envelope information; and generating display data for displaying spectra of audio signals obtained before and after interpolation in different modes;

wherein the step of generating the display data further comprises generating the display data based on frequency data and level data that are acquired from in-phase component signals and differential phase component signals obtained before and after being subjected to interpolation.

* * * * *